United States Patent [19]

Lohrman et al.

[11] 4,164,377

[45] Aug. 14, 1979

[54] DUAL-SEAL, BALL-TYPE DISPENSING PACKAGE

[75] Inventors: Richard D. Lohrman; George V. Mumford, both of Toledo, Ohio

[73] Assignee: Owens-Illinois, Inc., Toledo, Ohio

[21] Appl. No.: 842,717

[22] Filed: Oct. 17, 1977

[51] Int. Cl.[2] ..... B05C 17/02; B43K 9/00

[52] U.S. Cl. ..... 401/213; 401/216

[58] Field of Search ..... 401/208–220

[56] References Cited

U.S. PATENT DOCUMENTS

| | | | |
|---|---|---|---|
| 2,700,784 | 2/1955 | DeBrock | 401/213 |
| 2,975,466 | 3/1961 | Fillmore | 401/213 |
| 2,976,561 | 3/1961 | Culver | 401/213 |
| 2,997,731 | 8/1961 | Schultz | 401/213 |
| 2,998,616 | 9/1961 | Gentile | 401/213 |
| 3,134,131 | 5/1964 | Thomas | 401/213 |
| 3,284,839 | 11/1966 | Cook | 401/208 |
| 4,002,411 | 1/1977 | Harbauer | 401/213 |
| 4,030,844 | 6/1977 | Lench et al. | 401/213 |

*Primary Examiner*—Clyde I. Coughenour

*Attorney, Agent, or Firm*—J. R. Nelson; M. E. Click; D. H. Wilson

[57] ABSTRACT

An improved, dual-seal, ball-type dispensing package combination for cosmetics and the like. A dispensing ball is held in place in a fitment which is adapted to be attached to the finish portion of a container for the product to be dispensed. The ball is allowed to move freely within the fitment to facilitate uniform dispensing and application of the contents of the container. The total package is completed by a closure which engages threads on the exterior of the finish portion of the container. The closure, fitment, and ball cooperate to create a seal between the fitment and ball at two separate locations to prevent leakage of product when the closure is placed into full engagement with the container.

3 Claims, 5 Drawing Figures

DUAL-SEAL, BALL-TYPE DISPENSING PACKAGE

BACKGROUND OF THE INVENTION

This invention generally relates to ball-type applicators. More specifically, this invention relates to a complete ball-type applicator package, including a closure, a fitment, a ball and a container for the product to be dispensed. Particularly, this invention relates to an improved package wherein the dispensing fitment and the closure include mating portions which maintain the fitment and ball in sealing relationship with each other in two separate locations.

The ball-type applicator is well known in the art for dispensing of cosmetics of various types, particularly liquid deodorants and perfumes. Examples of pertinent prior art patents include U.S. Pat. Nos. 2,975,466 and 4,002,411. Each of these patents teaches the general combination of a closure, fitment and ball as applied to the finish portion of a container neck. However, in each of these patents, only a single seal is provided between the fitment and the dispensing ball upon application of the closure to the container. Thus, there is always the possibility of leakage of product from the container during shipping and storage of the assembled package. For example, if the fitment should become distorted or overstressed, such a single seal could fail and result in leakage.

SUMMARY OF THE INVENTION

It is, therefore, an object of this invention to overcome the disadvantages associated with the prior art ball-type dispensing packages by providing an improved, dual-seal package of this type.

The improved package of this invention incorporates dual seals between the ball-retaining fitment and the dispensing ball when the closure is placed in the fully engaged position with the container. In the design of this invention, a dispensing ball is held in place in a fitment which is adapted to be attached to the finish portion of a container for the product to be dispensed. The fitment is formed of a resilient material and includes a generally circular bottom diaphragm fitting within the opening of the container neck and which has at least one aperture for dispensing the contents of the container. The fitment includes an annular shoulder extending outwardly from the bottom diaphragm, an annular ball-retaining socket which extends upwardly from the shoulder in an arcuate configuration terminating in an annular sealing flange, and an annular container-engaging skirt which extends downwardly from the shoulder and is adapted to hold the fitment in engagement with the container. A dispensing ball is positioned within the annular ball-retaining socket of the fitment so as to be in communication with the dispensing apertures. A closure member is provided and includes an internal threaded portion adapted for engagement with a threaded portion on the neck of the container. The closure also includes inwardly directed means on its interior surface which engages the annular sealing flange on the ball-retaining socket to both wedge the flange into sealing engagement with the dispensing ball and to bias the dispensing ball into sealing engagement with the annular shoulder on the fitment to thereby create a double seal between the dispensing ball and the fitment.

IN THE DRAWINGS

Other objects, features and advantages of the subject invention will become apparent upon reference to the following detailed description of the invention and the drawings illustrating the preferred embodiments thereof.

DETAILED DESCRIPTION OF THE PREFERRED EMBODIMENTS

Figure 1:
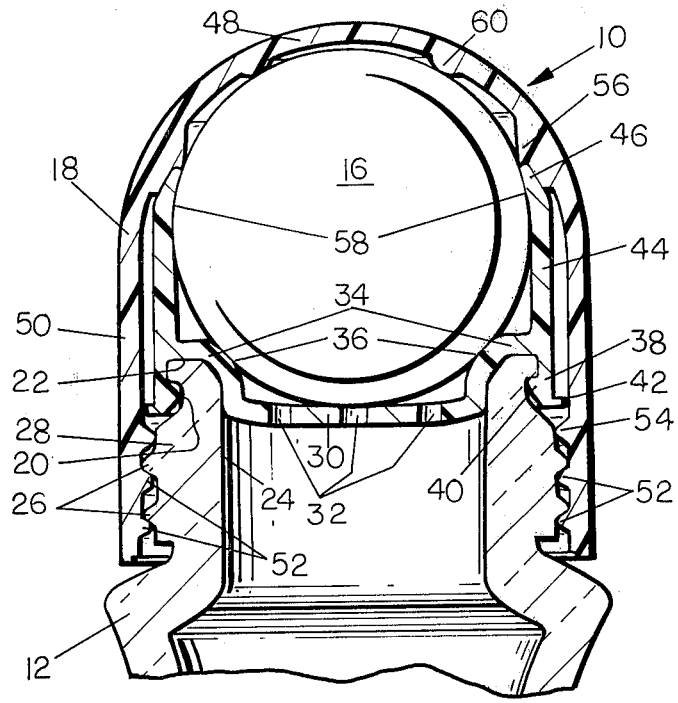
FIG. 1 is a cross sectional, side elevational view of the unique ball-type dispensing package of this invention.

Referring now to the drawings, FIG. 1 illustrates the unique, dual-seal, ball-type dispensing package of this invention which is indicated generally by the numeral 10. The package 10 includes a container 12 for the product to be dispensed, a ball-retaining fitment 14, which is snapped into engagement with the container 12, a dispensing ball 16, which is rotatably retained within the fitment 14, and a closure member 18 which encloses the fitment 14 and ball 16 and threads into engagement with the container 12.

The container 12 includes a neck portion 20 which terminates at its upper extremity in an annular rim 22 which defines the periphery of an open mouth 24 through which the product held within the container 12 may be dispensed. The container neck 20 includes a plurality of threads 26 on the outer surface thereof and a circumferential recess or groove 28 positioned adjacent to the annular rim 22. The remaining portion of the container 12 (not shown) may be of any suitable, aesthetically appealing, closed configuration for containing a cosmetic or the like.

The annular ball-retaining fitment 14 may be formed of a resilient material and includes a generally circular bottom diaphragm 30 which is sized to fit within the open mouth 24 of the container neck 20. The diaphragm 30 includes a plurality of apertures 32 formed therein for dispensing the product from within the container 12. An annular shoulder 34 extends outwardly from the diaphragm 30 and, upon application of closure 18, is adapted to form an annular seal with the dispensing ball 16 in the contact area indicated by the numeral 36. An annular container-engaging skirt 38 depends downwardly from the annular shoulder 34 and incorporates an inwardly directed bead 40 and an outwardly directed flange 42. The inwardly directed bead 40 is adapted for engagement with the circumferential groove 28 in the container neck 20 to securely fasten the fitment 14 to the container 12 and to prevent passage of product therebetween. An annular ball-retaining socket 44 extends upwardly from the annular shoulder 34 in an arcuate configuration and terminates at its outer extremity in an annular sealing flange 46. The fitment 14 is sized and shaped so that the ball 16 is held within the ball-retaining socket 44 and rests upon the diaphragm 30. In the absence of the closure member 18, the ball 16 must be permitted to rotate freely within the fitment 14 and must have a minor portion thereof extending beyond the upper extremity (flange 46) of the fitment for purposes of applying the product being dispensed.

The closure member 18 includes a generally dome-shaped top panel 48 and an annular skirt portion 50 which extends downwardly from the outer periphery of the top panel 48. The interior surface of the skirt 50 incorporates a plurality of threads 52 which are adapted to matingly engage with the threads 26 on the container neck 20 to achieve threaded engagement between the closure 18 and the container 12. The interior surface of the skirt 50 also incorporates an inwardly extending fitment-retaining bead 54 which is adapted to engage the outwardly directed flange 42 on the fitment 14 for the purpose of securing the fitment 14 and ball 16 within the closure 18 in a preassembled condition for shipping and storage prior to their assembly with the container 12. The top panel 48 of the closure 18 incorporates an inwardly directed annular bead 56 which is adapted to engage the sealing flange 46 on the fitment 14 to create a second seal between the fitment 14 and the ball 16 in the area indicated by the numeral 58. The internal surface of the top panel 48 may also incorporate an annular ball-contacting ring 60 which is adapted to contact the upper surface of the ball 16 over a limited circumferential area upon application of the closure 18 to the container 12. This annular ball-contacting ring 60 prevents a large surface-to-surface contact between the interior surface of the closure 18 and the ball 16 and the possible sticking problem that could result from product which remains on the ball 16.

Figure 4:
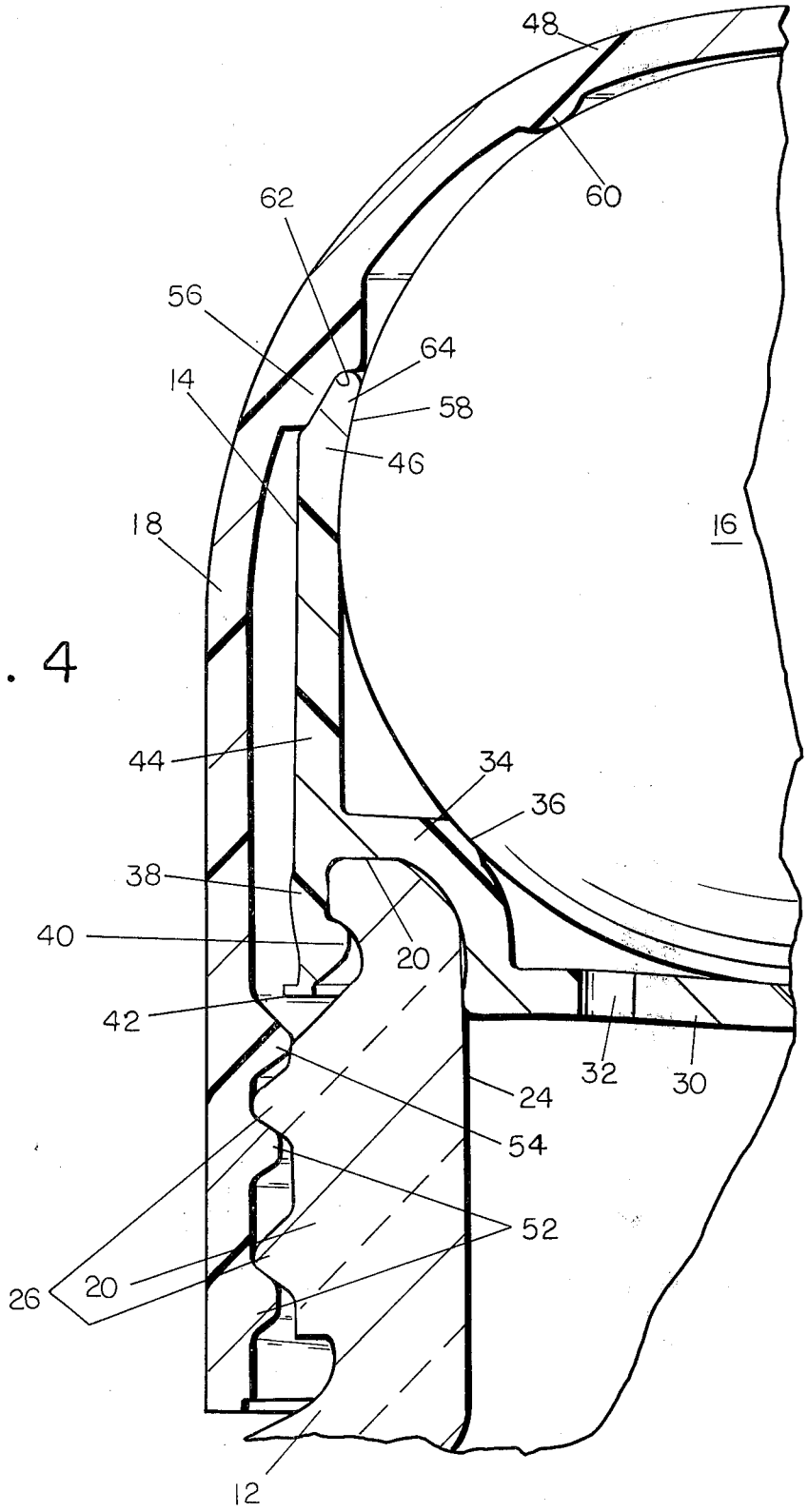
FIG. 4 is an enlarged, partial sectional view showing the relationship between components of this package which creates the double seal between the fitment and the dispensing ball.

A clearer understanding of the creation of a dual seal in the subject package can best be understood by reference to FIG. 4 which is an enlarged view of the configuration of FIG. 1. In FIG. 4, it can be seen that the annular bead 56 incorporates an annular recess 62 therein which is adapted to receive and be engaged by the upper tip 64 on the sealing flange 46. The relationship then between the annular bead 56 and the sealing flange 46 creates a wedging action as the closure 18 is threaded into engagement with the neck portion 20 of the container 12. This wedging action forces the annular sealing flange 46 into sealing engagement in the area identified as 58 to thereby create a seal between the fitment 14 and the ball 16. Simultaneously with the formation of the seal in the area indicated at 58, the ball 16 is biased into sealing engagement with the annular shoulder 34 on the fitment 14 creating an additional seal between the fitment 14 and the ball 16 in the area identified by the numeral 36. Thus, as can be seen in FIG. 4, as the closure 18 is applied into threaded engagement with the container 12, two separate annular seals are formed between the fitment 14 and the ball 16 in the area identified as 36 and 58 to thereby prevent leakage of the product from the container 12 during shipping and storage of the package. Thus, a relatively simple and lightweight package is provided for the dispensing of cosmetics or the like which incorporates a highly effective dual seal between the fitment and ball portions to eliminate the possibility of leakage which has been a problem in the prior devices of this type which rely upon a single seal.

Figure 5:
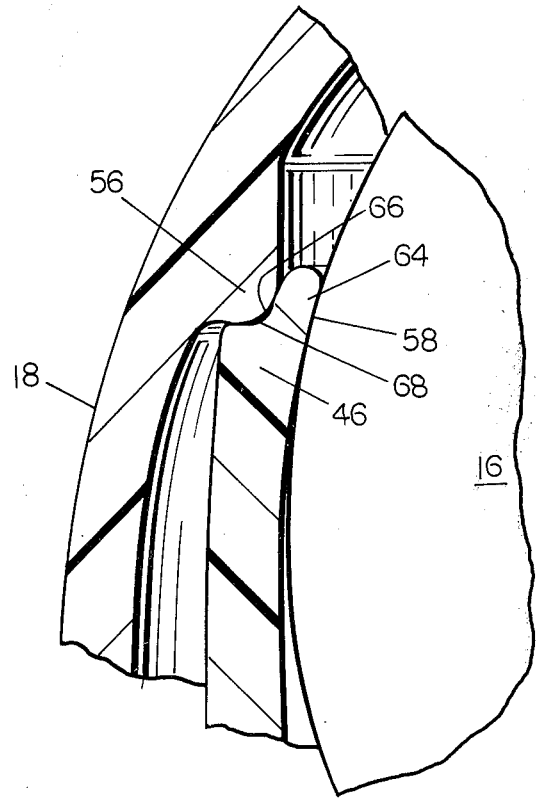
FIG. 5 is an enlarged fragmentary sectional view of an alternate configuration of a fitment and closure incorporating the features of this invention.
Figure 2:
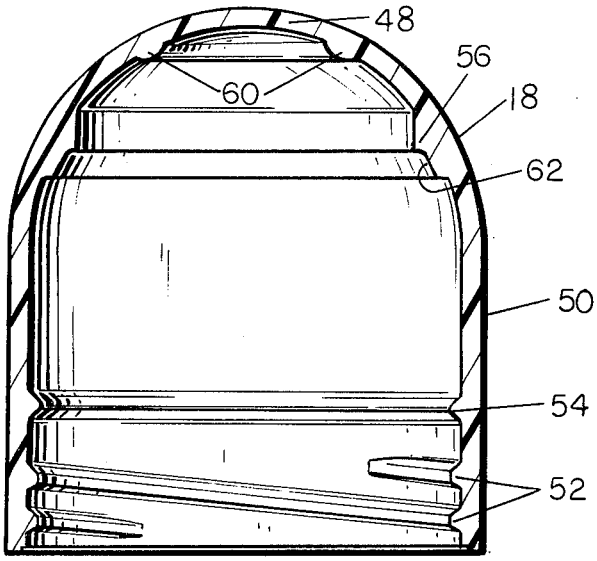
FIG. 2 is a side elevational view, with parts broken away in section, of the unique closure member used in the package of this invention.
Figure 3:
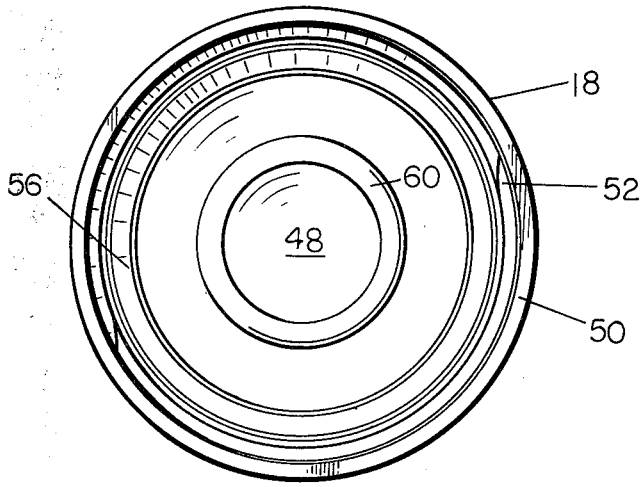
FIG. 3 is a bottom view of the closure of FIG. 2.

FIG. 5 discloses an alternate configuration for the relationship between the sealing bead 56 on the closure 18 and the sealing flange 46 on the fitment 14. In this embodiment, the sealing bead 56 incorporates a protruded nose portion 66, and the sealing flange 46 incorporates a cooperating annular groove or recess 68 adjacent its tip 64. In this embodiment, as the closure 18 is tightened into threaded engagement with the container 12, the enlarged nose portion 66 is received within the recess 68 to thereby engage the sealing flange 46 and wedge it into sealing engagement with the ball 16 in the area identified as 58. The remaining functional details of this FIG. 5 embodiment are identical to those described in connection with the embodiment of the other figures.

We claim:

1. In a ball-applicator dispensing package comprised of a container having a neck portion including an annular rim defining an end opening for dispensing the contents and external screw thread, and an annular groove above said thread and adjacent said rim, an annular ball-retaining fitment having an annular shoulder with a container-engaging skirt provided with inwardly directed bead engaged in said neck groove, and an axially extending, annular ball-retaining fitment having an annular shoulder with a container-engaging skirt provided with inwardly directed bead engaged in said neck groove, and an axially extending, annular ball-retaining socket member above said neck rim, a dispensing ball rotatably held by said socket of the fitment, a minor surface portion of the ball extending outwardly above said socket to define a dispensing surface, the improvement therein comprising a resilient annular flange portion on said socket member at the axial outer end thereof engageable with said ball above the maximum diameter thereof, and an annular surface portion on the shoulder thereof engageable with said ball below the maximum lateral diameter thereof, said flange portion and said annular surface on the shoulder of the fitment being operable, respectively, for substantially simultaneously, sealingly engaging the ball against leakage, a radially outwardly extending flange on said annular shoulder skirt of the fitment disposed opposite the inwardly directed retaining bead thereon, said skirt flange having an external diametrical dimension slightly greater than that of the ball-retaining socket member of the fitment, said fitment including a generally circular diaphragm connected with said annular shoulder and adapted to fit in the end opening of the container, said diaphragm having at least one aperture for dispensing content of the container, and a screw closure member closed at a dome-shaped end having an interiorly threaded skirt engageable with the thread on said neck of the container and including a radially inwardly extending annular bead on said skirt above the threads thereof, the internal diameter of said bead being slightly less than the diameter of the radial flange on said fitment skirt, whereby the fitment is adapted for preassembly with the screw closure prior to assembly on the container, and an inwardly-directed annular bead on the interior of said closure member for exteriorly engaging said flange portion of the fitment during screw application thereof on said container, the engagement of said annular bead of the closure with the annular resilient flange of the fitment wedging said flange against said ball to form a first seal therebetween in the dispensing package, and simultaneously downwardly loading the socket member and ball to form a second seal between the annular shoulder of the fitment and the ball.

2. The improved ball-applicator dispensing package of claim 1 wherein said resilient annular sealing flange on the ball-retaining socket of the fitment includes an annular recess adapted to receive and be engaged by said annular bead, the latter being disposed at said closed end of said closure member.

3. The improved ball-applicator dispensing package of claim 1 wherein said annular bead is disposed at said closed end of the closure member and includes an annular recess thereon adapted to receive and engage with the annular sealing flange of the ball-retaining socket of the fitment.

* * * * *